US011825587B2

(12) United States Patent
Jung et al.

(10) Patent No.: US 11,825,587 B2
(45) Date of Patent: Nov. 21, 2023

(54) TRANSPARENT ELECTROMAGNETIC SHIELDING PANELS AND ASSEMBLIES CONTAINING THE SAME

(71) Applicant: SABIC GLOBAL TECHNOLOGIES B.V., Bergen op Zoom (NL)

(72) Inventors: Jinju Jung, Gyeonggi-do (KR); Bongjun Park, Gyeonggi-do (KR); Michael J. Davis, Mount Vernon, IN (US)

(73) Assignee: SABIC GLOBAL TECHNOLOGIES B.V., Bergen op Zoom (NL)

( * ) Notice: Subject to any disclaimer, the term of this patent is extended or adjusted under 35 U.S.C. 154(b) by 582 days.

(21) Appl. No.: 16/969,352

(22) PCT Filed: Feb. 13, 2019

(86) PCT No.: PCT/IB2019/051164
§ 371 (c)(1),
(2) Date: Aug. 12, 2020

(87) PCT Pub. No.: WO2019/159078
PCT Pub. Date: Aug. 22, 2019

(65) Prior Publication Data

US 2021/0051774 A1 Feb. 18, 2021

(30) Foreign Application Priority Data

Feb. 13, 2018 (EP) ..... 18156583

(51) Int. Cl.
*H05B 6/76* (2006.01)
*H05B 6/72* (2006.01)
*H05B 6/64* (2006.01)

(52) U.S. Cl.
CPC ..... *H05B 6/766* (2013.01); *H05B 6/6414* (2013.01); *H05B 6/763* (2013.01)

(58) Field of Classification Search
CPC ..... H05B 6/6414; H05B 6/763; H05B 6/766
(Continued)

(56) References Cited

U.S. PATENT DOCUMENTS 5,863,673 A * 1/1999 Campbell ..... H01M 4/8626 429/535
6,822,208 B2 * 11/2004 Henze ..... F24C 15/04 126/200

(Continued)

FOREIGN PATENT DOCUMENTS

CN 201383886 Y 1/2010
CN 204987134 U 1/2016

(Continued)

OTHER PUBLICATIONS

Boxman et al., "Clear etalon windows for domestic microwave ovens: Analysis and measurement", Microwave and RF Power Applications: Proceeding of the 13th International Conference on Microwave and Radio Frequency Heating, AMPERE, 2011, 5 pages.

(Continued)

*Primary Examiner* — Quang T Van
(74) *Attorney, Agent, or Firm* — CANTOR COLBURN LLP

(57) ABSTRACT

A viewing panel (30, 40, 50, 60, 70, 80) for a domestic appliance includes a substrate (33, 43, 53, 63, 73, 83) and a conductive layer (35, 45, 55, 65, 75, 85) disposed on the substrate; the conductive layer having conductive lines (31, 41, 51, 61, 71, 81) forming a pattern. The substrate contains a polymeric material; the conductive lines have a height (H) of 0.5 micrometers to 10 micrometers determined by an Olympus MX61 microscope; and the pattern has an average pore area of 0.008 square millimeters to 0.06 square millimeters determined by an Olympus MX61 microscope. The viewing panel has: a total transmission of greater than 70%

(Continued)

of light having a wavelength in the range of 360 nanometers to 750 nanometers; and an electromagnetic shielding efficiency of greater than 30 dB at 2.45 GHz.

16 Claims, 10 Drawing Sheets

(58) Field of Classification Search
USPC ..... 219/756, 739, 740, 741, 742, 743, 744, 219/736, 737, 738
See application file for complete search history.

(56) References Cited

U.S. PATENT DOCUMENTS

| | | | | |
|---|---|---|---|---|
| 8,502,125 | B2 | 8/2013 | Danzer et al. | |
| 8,772,687 | B2 | 7/2014 | Boxman et al. | |
| 8,908,267 | B2 | 12/2014 | Mccarthy et al. | |
| 2018/0220501 | A1* | 8/2018 | Jung | C08J 7/046 |

FOREIGN PATENT DOCUMENTS

| | | | |
|---|---|---|---|
| GB | 2322276 | A | 8/1998 |
| JP | H02253509 | A | 10/1990 |
| JP | H07122359 | A | 5/1995 |
| JP | 2000208249 | A | 7/2000 |
| JP | 2006170578 | A | 6/2006 |
| WO | 2015145355 | A1 | 10/2015 |
| WO | 2016144312 | A1 | 9/2016 |
| WO | 2017187425 | A1 | 11/2017 |
| WO | 2018038390 | A1 | 3/2018 |

OTHER PUBLICATIONS

European Search Report for European Application No. 18156583.9 dated Jul. 20, 2018, 8 pages.
International Search Report for International Application No. PCT/IB2019/051164, International Filing Date Feb. 13, 2019, dated May 27, 2019, 3 pages.
Murugan et al., "Dual Frequency Selective Transparent Front Doors for Microwave Oven with Different Opening Areas", Progress in Electromagnetics Research Letters, vol. 52, 2015, pp. 11-16.
Rubinger et al., "Microwave shielding of fluorine-doped tin oxide film obtained by spray pyrolysis studied by electrical characterization", Journal of Applied Physics, vol. 105, 2009, 5 pages.
Written Opinion for International Application No. PCT/IB2019/051164, International Filing Date Feb. 13, 2019, dated May 27, 2019, 6 pages.

* cited by examiner

TRANSPARENT ELECTROMAGNETIC SHIELDING PANELS AND ASSEMBLIES CONTAINING THE SAME

CROSS REFERENCE TO RELATED APPLICATIONS

This application is a National Stage application of PCT/IB2019/051164, filed Feb. 13, 2019, which claims the benefit of European Application No. 18156583.9, filed Feb. 13, 2018, both of which are incorporated by reference in their entirety herein.

BACKGROUND

The disclosure relates to electromagnetic shielding panels and assemblies containing the same, and in particular transparent electromagnetic shielding panels and assemblies and their methods of manufacture.

To meet industry or governmental regulations, microwave oven doors often have certain electromagnetic interference (EMI) shielding capacity to limit electromagnetic radiation from transmission outside the microwave ovens. Conventional microwave oven doors often include a perforated metal sheet for this purpose. However, although perforated metal sheets can effectively limit microwave radiation transmission, they can also limit transmission of light visible to the human eye. As a result, a microwave oven door having a perforated metal sheet can obscure the image of a food item placed inside the oven cavity, which can be undesirable to the consumers. WO 2015/145355 discloses a method of forming a viewing panel for a microwave oven. The method includes placing a film including a conductive coating into a mold and molding a substrate to a surface of the film having the conductive coating to form the viewing panel, or injection molding a substrate and applying a conductive coating to a surface of the substrate after molding to form the viewing panel. GB2322276 discloses a microwave oven door having a metal mesh screen that reflects microwave energy back into the cooking chamber, and a microwave absorbing film spaced from the screen. JP2006170578 discloses a microwave heating device including a see-through window having a heat resistant glass and a metal slit plate with small holes. WO2018/038390 discloses a cooking appliance including a door having a shielding member woven with conductive wires and a fixing member to electrically connect the shielding member with a doorframe.

Because of the broad use of microwave oven doors, there remains a need in the art for a viewing panel having increased visible light transmittance. It would be a further advantage if the viewing panel has further enhanced electromagnetic shielding capacity.

SUMMARY

A viewing panel (30, 40, 50, 60, 70, 80) for a domestic appliance comprises a substrate (33, 43, 53, 63, 73, 83) and a conductive layer (35, 45, 55, 65, 75, 85) disposed on the substrate; the conductive layer comprising conductive lines (31, 41, 51, 61, 71, 81) forming a pattern. The viewing panel is characterized in that: the substrate comprises a polymeric material; the conductive lines have a height (H) of 0.5 micrometers to 10 micrometers determined by an Olympus MX61 microscope; and the pattern has an average pore area of 0.008 square millimeters to 0.06 square millimeters determined by an Olympus MX61 microscope; wherein the viewing panel has: a total transmission of greater than 70% of light having a wavelength in the range of 360 nanometers to 750 nanometers determined according to ASTM D-1003-00, Procedure A, under D65 illumination, with a 10 degrees observer, at a sample thickness of 0.15 millimeter using a Haze-Gard test device; and an electromagnetic shielding efficiency of greater than 30 dB at 2.45 GHz as determined by ASTM D4935.

An assembly for a domestic appliance is also disclosed. The assembly comprises the above-described viewing panel and a metal frame, wherein the conductive lines of the viewing panel are electrically grounded to the metal frame.

A method of forming a viewing panel (30, 40, 50, 60, 70, 80) for a domestic appliance comprises: forming a conductive pattern via conductive lines (31, 41, 51, 61, 71, 81) directly on a substrate (33, 43, 53, 63, 73, 83) or on a polymer film (32, 42, 52, 62) disposed on a surface of the substrate. The method characterized in that: the conductive lines have a height (H) of 0.5 micrometers to 10 micrometers determined by an Olympus MX61 microscope; the conductive pattern has an average pore area of 0.008 square millimeters to 0.06 square millimeters determined by an Olympus MX61 microscope, and the base substrate comprises a polymeric material, wherein the viewing panel has: a total transmission of greater than 70% of light having a wavelength in the range of 360 nanometers to 750 nanometers determined according to ASTM D-1003-00, Procedure A, under D65 illumination, with a 10 degrees observer, at a sample thickness of 0.15 millimeter using a Haze-Gard test device; and an electromagnetic shielding efficiency of greater than 30 dB at 2.45 GHz as determined by ASTM D4935.

A method of forming an assembly for a domestic appliance comprises forming a viewing panel in accordance with the above-described method; and integrating the viewing panel with a metal frame, the viewing panel being electrically grounded to the metal frame.

BRIEF DESCRIPTION OF THE DRAWINGS

A description of the figures, which are meant to be exemplary and not limiting, is provided in which.

DETAILED DESCRIPTION

Viewing panels having balanced visible light transmission and electromagnetic shielding efficiency are provided. Advantageously, the viewing panels also have long-term reliability in terms of microwave radiation leakage and heat resistance. The viewing panels comprise a substrate and a conductive layer disposed on the substrate.

The conductive layer has conductive lines forming a pattern, which can be regular or irregular. Exemplary patterns include rectangular, honeycomb, hexagon, polygon, and the like. The pattern has various pores having an average pore area of 0.008 square millimeters to 0.06 square millimeters or 0.008 square millimeters to 0.04 square millimeters determined by an Olympus MX61 microscope. As used herein, a pore refer to the smallest unit formed by the conductive lines. In other words, the spaces between adjacent lines. The pore area is determined using an Olympus MX61 microscope. The inventors hereof have found that viewing panels having balanced visible light transmission and EMI shielding efficiency can be provided by tuning the size of the pores formed by the conductive lines. Without being bound by theory, it is believed that when the average pore area is more than 0.06 square millimeters, the electromagnetic shielding efficiency can be compromised. Further, without being bound by theory, it is believed that when the average pore area is less than 0.008 square millimeters, electromagnetic shielding efficiency no longer has any meaningful improvement while the transmission of visible light can be severely deteriorated.

Figure 1A:
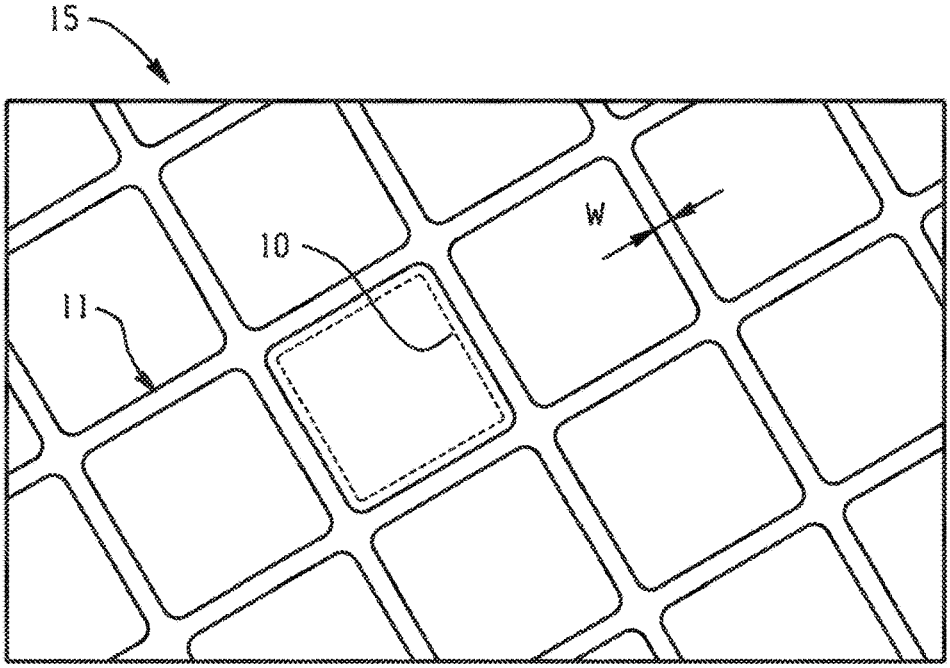
FIG. 1A is a microscope image of an exemplary conductive pattern according to an embodiment of the disclosure.
Figure 1B:
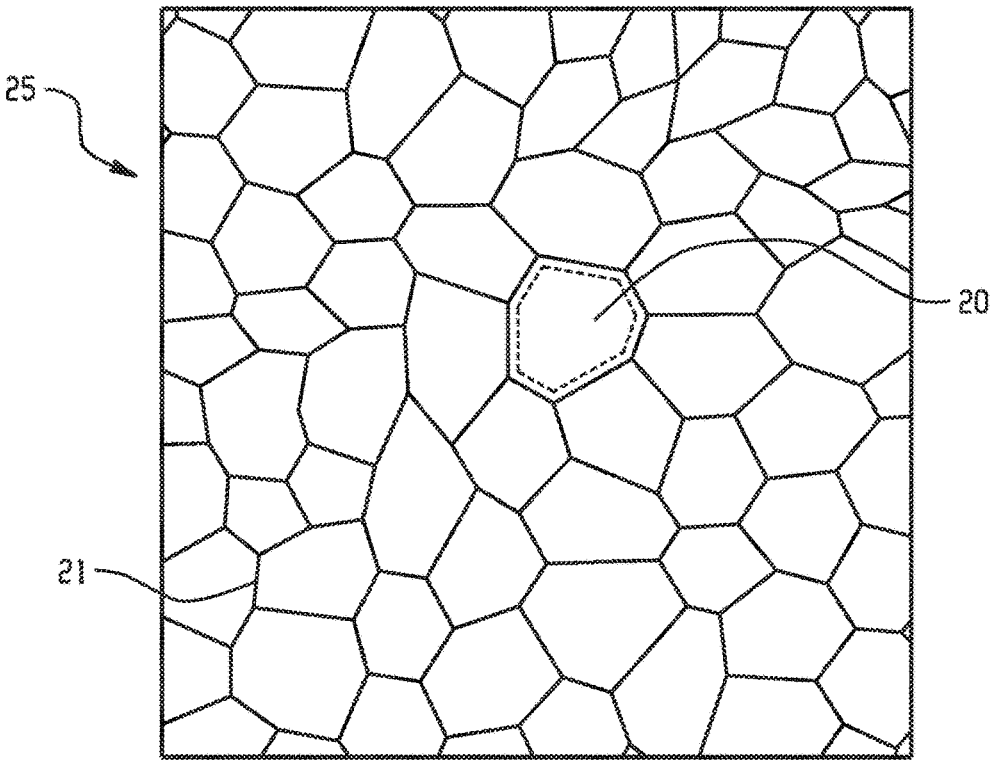
FIG. 1B is a microscope image of an exemplary conductive pattern according to another embodiment of the disclosure.

FIGS. 1A and 1B are microscope images of exemplary conductive patterns. In FIG. 1A, the conductive lines 11, which have a width W, form a regular pattern 15 that has various pores 10. In FIG. 1B, the conductive lines 21 form an irregular pattern 25, which has various pores 20.

The conductive lines comprise at least one of silver, copper, nickel, and aluminum. Preferably, the conductive lines comprise at least one of a silver alloy, a copper alloy, a nickel alloy, and an aluminum alloy. The conductive lines have a thickness or height (H) of 0.5 micrometers to 10 micrometers, measured using an Olympus MX61 microscope. The conductive lines can have a uniform width. Alternatively, the conductive lines have a width falling within two ranges, where one range is 5 to 12 microns for example, and the other range is greater than 10 millimeters. Wider lines provide better electrical contact with a metal frame when the viewing panel is incorporated into an assembly.

The conductive lines can be directly disposed on a surface of the substrate, i.e., in physical contact with the surface of the substrate. The conductive lines can also be disposed on a polymer film, which in turn is deposited on a surface of the substrate, where the conductive lines and the polymer film together form the conductive layer. The polymer film can have the same polymer material or can include different polymer materials as the substrate. In an embodiment, the polymer film contains an UV curable polymeric material.

The substrate can comprise a polymeric material such as a thermoplastic polymer, a thermoset polymer, or a combination comprising at least one of the foregoing.

Polymeric materials are chosen based upon microwave oven door requirements such as transparency level and heat resistance. Possible polymeric materials include, but are not limited to, oligomers, polymers, ionomers, dendrimers, and copolymers such as graft copolymers, block copolymers (e.g., star block copolymers, random copolymers, and the like) or a combination comprising at least one of the foregoing. Examples of such polymeric materials include, but are not limited to, polyesters, polycarbonates, polystyrenes (e.g., copolymers of polycarbonate and styrene, polyphenylene ether-polystyrene blends), polyimides (e.g., polyetherimides), acrylonitrile-styrene-butadiene (ABS), polyarylates, polyalkylmethacrylates (e.g., polymethylmethacrylates (PMMA)), polyolefins (e.g., polypropylenes (PP) and polyethylenes, high density polyethylenes (HDPE), low density polyethylenes (LDPE), linear low density polyethylenes (LLDPE)), polyamides (e.g., polyamideimides), polyarylates, polysulfones (e.g., polyarylsulfones, polysulfonamides), polyphenylene sulfides, polytetrafluoroethylenes, polyethers (e.g., polyether ketones (PEK), polyether etherketones (PEEK), polyethersulfones (PES)), polyacrylics, polyacetals, polybenzoxazoles (e.g., polybenzothiazinophenothiazines, polybenzothiazoles), polyoxadiazoles, polypyrazinoquinoxalines, polypyromellitimides, polyquinoxalines, polybenzimidazoles, polyoxindoles, polyoxoisoindolines (e.g., polydioxoisoindolines), polytriazines, polypyridazines, polypiperazines, polypyridines, polypiperidines, polytriazoles, polypyrazoles, polypyrrolidones, polycarboranes, polyoxabicyclononanes, polydibenzofurans, polyphthalamide, polyacetals, polyanhydrides, polyvinyls (e.g., polyvinyl ethers, polyvinyl thioethers, polyvinyl alcohols, polyvinyl ketones, polyvinyl halides, polyvinyl nitriles, polyvinyl esters, polyvinylchlorides), polysulfonates, polysulfides, polyureas, polyphosphazenes, polysilazanes, polysiloxanes, fluoropolymers (e.g., polyvinyl fluoride (PVF), polyvinylidene fluoride (PVDF), polyvinyl fluoride (PVF), fluorinated ethylene-propylene (FEP), polyethylene tetrafluoroethylene (ETFE)) or a combination comprising at least one of the foregoing. High heat polycarbonates, particularly high heat polycarbonate homopolymers, high heat copolycarbonates and high heat polycarbonate copolymers comprising carbonate units and ester units (also known as poly(ester carbonates)) are especially preferred for a balance of light transmission and heat resistance.

The polymeric material has a glass transition temperature that is equal to or greater than the maximum surface temperature of the substrate during a microwave operation. As used herein, a microwave operation refers to an operation of a microwave oven or an operation of a microwave and convection oven combination unit. Exemplary operations include, but are not limited to, microwave mode, grill mode, convection mode, crisp mode, or a combination thereof.

In an embodiment, the polymeric material has a glass transition temperature of 100° C. to 250° C. or 140° C. to 250° C., preferably 140° C. to 195° C., and more preferably 150° C. to 250° C. or 150° C. to 175° C., determined by differential scanning calorimetry (DSC) as per ASTM D3418 with a 20° C./min heating rate. As used herein, high heat materials refer to materials having a glass transition temperature as defined herein. The polymeric material can also have excellent transparency. For example, the polymeric material can have a haze of less than 10%, or less than 5%, and a total transmission greater than 70% or greater than 75% of light having a wavelength in the range of 360 nanometers to 750 nanometers, each measured according to ASTM D1003-00 Procedure A, under D65 illumination, with a 10 degrees observer, at a sample thickness of 0.15 millimeter or 0.175 millimeter using a Haze-Gard test device. Without wishing to be bound by theory, it is believed that the improved thermostability of the substrate under a high temperature such as 140° C.-250° C. allows the conductive layer to have a reduced height since there is a less demanding need to dissipate the heat generated during a microwave operation.

In an embodiment the substrate comprises transparent and high heat phthalimidine copolycarbonates having bisphenol A carbonate units and phthalimidine carbonate units of formula (1)

(1)

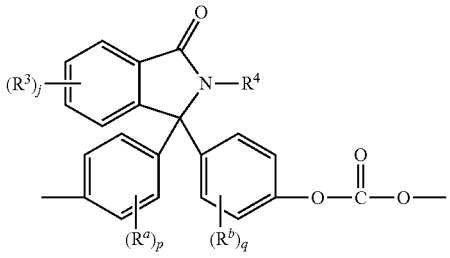

wherein $R^a$ and $R^b$ are each independently a $C_{1-12}$ alkyl, $C_{2-12}$ alkenyl, $C_{3-8}$ cycloalkyl, or $C_{1-12}$ alkoxy, preferably a $C_{1-3}$ alkyl, each $R^3$ is independently a $C_{1-6}$ alkyl, $R^4$ is hydrogen, $C_{1-6}$ or $C_{2-6}$ alkyl or phenyl optionally substituted with 1 to 5 $C_{1-6}$ alkyl groups, and p and q are each independently 0 to 4, preferably 0 to 1. For example, the phthalimidine carbonate units can be of formula (1a)

(1a)

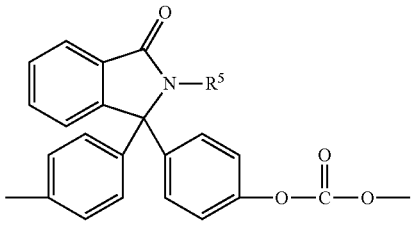

wherein $R^5$ is hydrogen, phenyl optionally substituted with up to five $C_{1-6}$ alkyl groups, or $C_{1-4}$ alkyl, such as methyl or $C_{2-4}$ alkyl. In an embodiment, $R^5$ is hydrogen or phenyl, preferably phenyl. Carbonate units (1a) wherein $R^5$ is phenyl can be derived from 2-phenyl-3,3'-bis(4-hydroxy phenyl) phthalimidine (also known as 3,3-bis(4-hydroxyphenyl)-2-phenylisoindolin-1-one or N-phenyl phenolphthalein bisphenol or "PPPBP"). Bisphenol A carbonate units have formula (2).

(2)

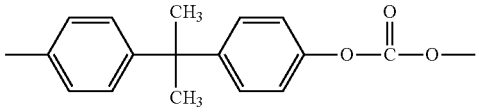

The phthalimidine copolycarbonate comprises 15 to 90 mole percent (mol %) of the bisphenol A carbonate units and 10 to 85 mol % of the phthalimidine carbonate units, preferably the copolycarbonate comprises from 50 to 90 mol % of the bisphenol A carbonate units and 10 to 50 mol % of the phthalimidine carbonate units, and more preferably the copolycarbonate comprises from 50 to 70 mol % of the bisphenol A carbonate units, 30 to 50 mol % of the phthalimidine carbonate units, or 60 to 70 mol % of the bisphenol A carbonate units and 30 to 40 mol % of the phthalimidine carbonate units, each based on the total number of carbonate units in the phthalimidine copolycarbonate. Optionally the phthalimidine copolycarbonate is blended with a bisphenol A homopolycarbonate.

A combination of glass and polymeric material can be used. For example, the substrate can be a glass laminated with a film comprising the polymeric material.

The polymeric substrate can include various additives ordinarily incorporated into polymer compositions of this type, with the proviso that the additive(s) are selected to not adversely affect the desired properties of the polymer, in particular, transparency, deflection, stress, and flexural stiffness. Such additives can be mixed at a suitable time during the mixing of the components for forming the substrate and/or film. Exemplary additives include impact modifiers, fillers, reinforcing agents, antioxidants, heat stabilizers, light stabilizers, ultraviolet (UV) light stabilizers, plasticizers, lubricants, mold release agents, antistatic agents, colorants (such as carbon black and organic dyes), surface effect additives, radiation stabilizers (e.g., infrared absorbing), flame retardants, and anti-drip agents. A combination of additives can be used, for example, a combination of a heat stabilizer, mold release agent, and ultraviolet light stabilizer. The total amount of additives (other than any impact modifier, filler, or reinforcing agents) can be 0.001 weight percent (wt %) to 5 wt %, based on the total weight of the composition of the substrate and/or film.

The substrate can be a sheet, film, or a molded part. The perimeter shape of the substrate can be any shape, e.g., circular, elliptical, or the shape of a polygon having straight or curved edges. The thickness of the substrate can vary. In an embodiment, the substrate has a thickness of equal to or greater than 0.1 millimeter, for example, from 0.1 millimeter to 5 millimeters, from 0.1 millimeter to 2 millimeters, from 0.1 to 1 millimeter, or from 0.1 millimeter to 0.8 millimeter.

Figure 2A:
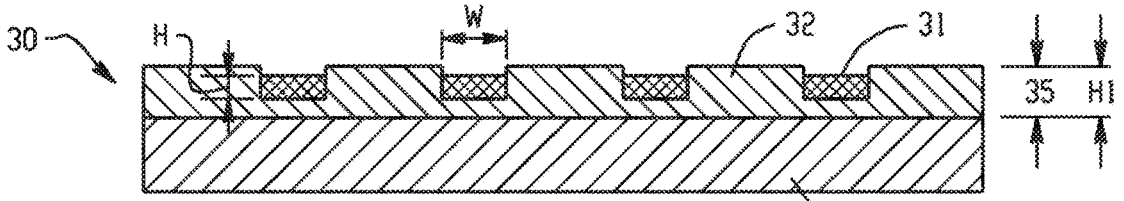
FIG. 2A is a cross-sectional view of a portion of an exemplary viewing panel having a substrate and a conductive layer, wherein the conductive layer has a concave shape and contains conductive lines with uniform line width.
Figure 2B:
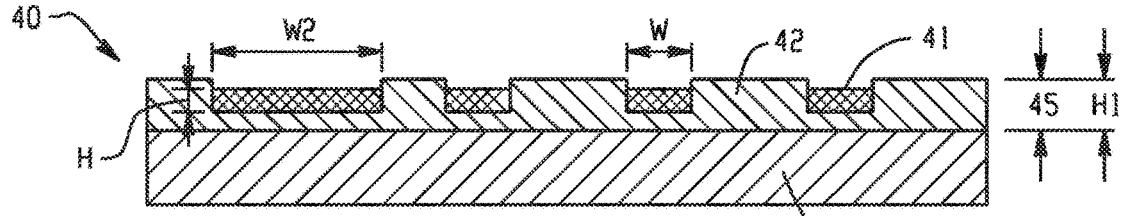
FIG. 2B is a cross-sectional view of a portion of an exemplary viewing panel of FIG. 3A along A-A' direction, the viewing panel having conductive lines with non-uniform line width.
Figure 2C:
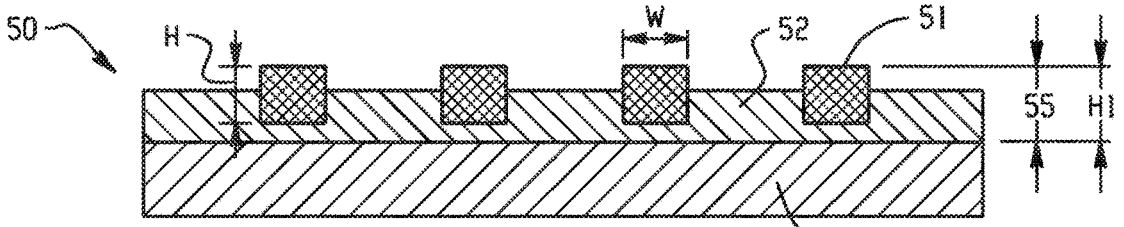
FIG. 2C is a cross-sectional view of a portion of an exemplary viewing panel having a substrate and a conductive layer, wherein the conductive layer has a convex shape and contains conductive lines with uniform line width.
Figure 2D:
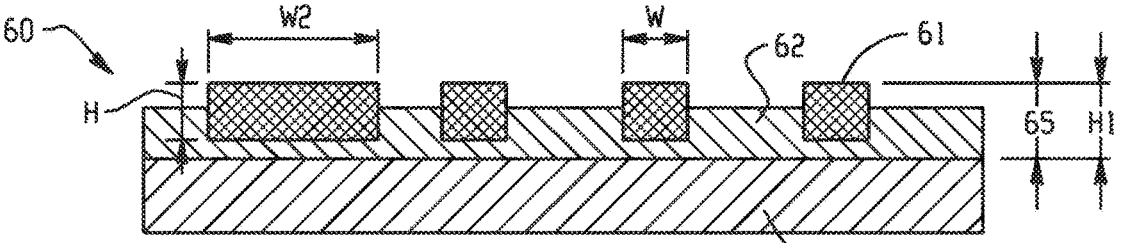
FIG. 2D is a cross-sectional view of a portion of an exemplary viewing panel having a substrate and conductive layer, wherein the conductive layer has a convex shape and contains conductive lines with non-uniform line width.
Figure 2E:
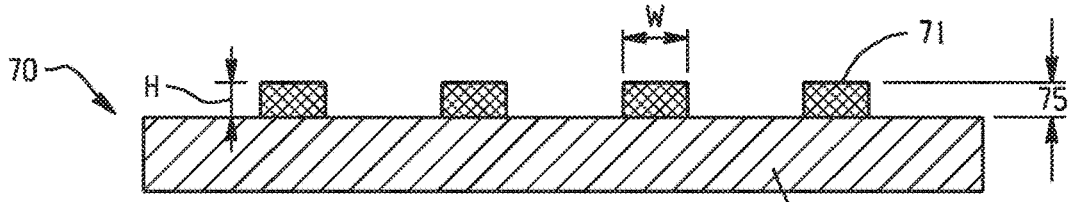
FIG. 2E is a cross-sectional view of a portion of a viewing panel having a substrate and conductive lines with uniform line width disposed directly on the substrate.
Figure 2F:
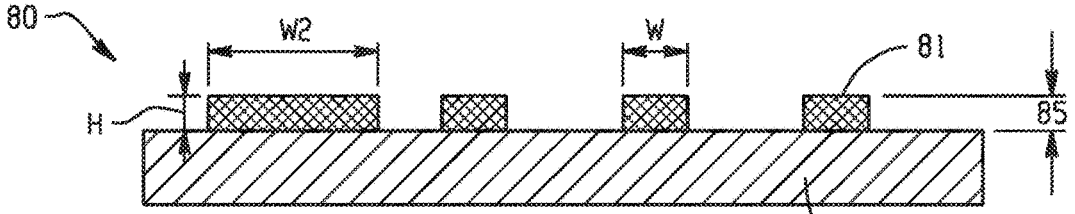
FIG. 2F is a cross-sectional view of a portion of a viewing panel having a substrate and conductive lines with non-uniform line width disposed directly on the substrate.
Figure 3A:
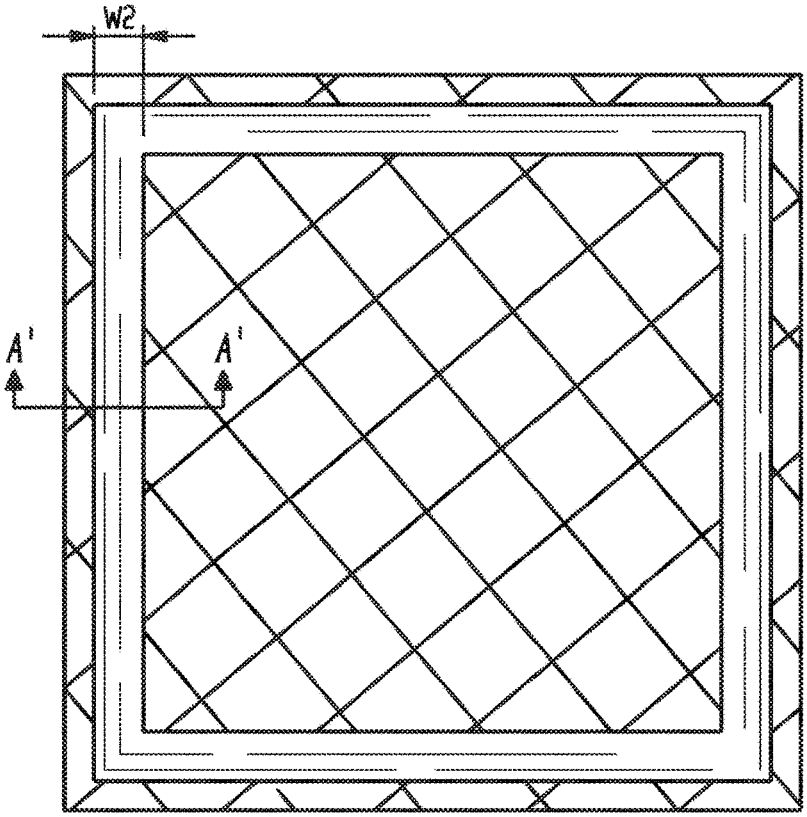
FIG. 3A is a top view of an exemplary viewing panel having non-uniform line width.
Figure 3B:
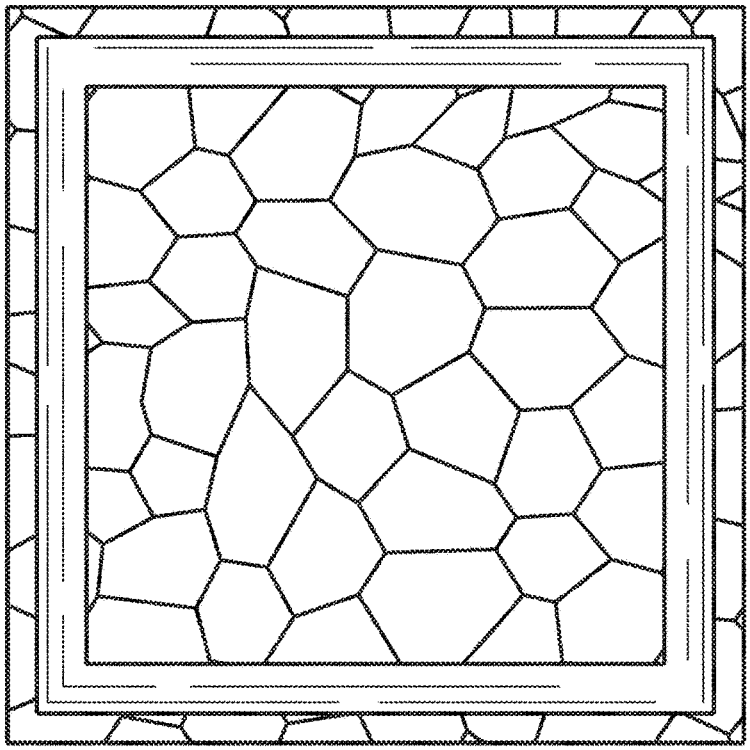
FIG. 3B is a top view of another exemplary viewing panel having non-uniform line width.

Exemplary viewing panels are illustrated in FIGS. 2A-3B. Viewing panels (30, 40, 50, 60, 70, and 80) have a substrate (33, 43, 53, 63, 73, and 83) and conductive lines (31, 41, 51, 61, 71, and 81), which are either disposed on a polymer film (32, 42, 52, and 62) as shown in FIGS. 2A-2D or directly on the substrate as shown in FIGS. 2E and 2F. The conductive lines together with the polymer film, if present, form a conductive layer (35, 45, 55, 65, 75, and 85). The conductive layer has a height (H1) or thickness, which is 0.1 micrometer to 12 micrometers or 0.5 micrometer to 10 micrometers. The conductive lines have a thickness or height (H), which is 0.5 micrometer to 10 micrometers. The width of the conductive lines can be uniform or non-uniform. FIGS. 2A, 2C, and 2E illustrate viewing panels having conductive lines with a uniform line width W. FIGS. 2B, 2D, and 2F illustrate viewing panels having conductive lines with at least a first width W and a second width W2, where the second width is significantly more than the first width. The conductive lines having a width of W2 can be disposed around the perimeters of the viewing panel as shown in FIGS. 3A and 3B. It is appreciated that the conductive lines having a width W2 can be disposed at other locations as well. In the event that the conductive lines are disposed on a polymer film, the conductive lines and the polymer film together can have a concave shape (FIGS. 2A and 2B) or a convex shape (FIGS. 2C and 2D).

The viewing panels can be manufactured by forming a conductive pattern directly on a substrate or on a polymer film disposed on a surface of the substrate. The substrate can be formed by an extrusion, calendaring, molding (e.g., injection molding), thermoforming, vacuum forming, or other desirable forming process. The substrate can be made as a flat sheet. The substrate can be formed with curvature.

The conductive lines (e.g., conductive metal nanoparticle layers) can be applied to a substrate or a polymer film by several techniques, including, printing of conductive inks (e.g., imprinting, silk screen printing, flexographic, screen printing, inkjet, gravure offset, reverse offset printing, and photolithography), coating and patterning of e.g., silver halide emulsions which can be reduced to silver particles, and self-assembly of silver nanoparticle dispersions or emulsions. The polymer film, if present, can be laminated to the substrate either before the conductive lines are disposed on the polymer film or after the conductive lines are disposed on the polymer film.

The viewing panels as disclosed herein can have excellent transparency. In an embodiment, the viewing panels have a total transmission of greater than 70% of light having a wavelength in the range of 360 nanometers to 750 nanometers determined according to ASTM D-1003-00, Procedure A, under D65 illumination, with a 10 degrees observer, at a thickness of 0.15 millimeter or 0.175 millimeter using a Haze-Gard test device. The viewing panels can have a haze of less than 10% determined according to ASTM D-1003-00, Procedure A, under D65 illumination, with a 10 degrees observer, at a thickness of 0.15 millimeter or 0.175 millimeter using a Haze-Gard test device.

The viewing panels can also have excellent electromagnetic shielding efficiency. In an embodiment, the viewing panels have an electromagnetic shielding efficiency of greater than 30 decibel (dB) at 2.45 gigahertz (GHz) as determined by ASTM D4935. The viewing panel can also have an electromagnetic leakage of less than 1.0 milliWatt per square centimeter ($mW/cm^2$) at 2.45 GHz under loading conditions as defined in Underwriters Laboratories standard 923 (UL923).

The viewing panels have a low surface resistance. Without wishing to be bound by theory, it is believed that low surface resistance contributes to improved electromagnetic shielding efficiency. In an embodiment, the viewing panels have a surface resistance of less than or equal to 1.0 ohm per square (ohm/sq).

The viewing panels can be integrated with a metal frame to provide an assembly for a domestic appliance. In the assembly, the conductive lines of the viewing panel are electrically grounded to the metal frame. The percentage of grounding contact area can vary depending on the size of the assembly, in particular, the size of the viewing panel.

The electrical connection between the conductive lines and metal frame can be accomplished by various techniques, including, but not limited to conductive inks or pastes, conductive tape such as copper tape, soldered connections, conductive adhesives, or direct electrical contact. One end of the connection can be attached to the metal frame, while the other end of the connection can be attached to the conductive lines. The electrical attachment to the conductive lines can be done at multiple locations or even continuously around the perimeters to provide sufficient connection to all parts of the conductive pattern. The conductive lines that are in direct electrical contact with the metal frame or in direct electrical contact with the conductive adhesive have a width of greater than 10 millimeters. In an embodiment, the total contact area between the conductive lines and the metal frame is more than 15% of the surface area of the substrate. Larger contact area leads to better shielding performance as well as stronger adhesion between the viewing panel and the metal frame. The maximum total contact area between the conductive lines and the metal frame can be adjusted based on the desired size of the viewing panel.

The metal frame can abut a perimeter edge of the viewing panel. The metal frame can extend along a portion of the perimeter of the viewing panel. The metal frame can also extend along the entire perimeter of the viewing panel such that it surrounds the viewing panel.

Figure 4A:
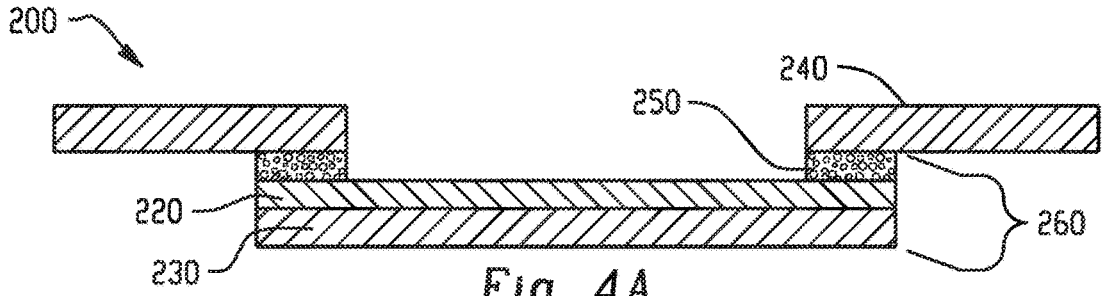
FIG. 4A is a cross-sectional view of an exemplary assembly having a viewing panel, a metal frame, and a conductive adhesion layer disposed between the viewing panel and the metal frame.
Figure 4B:
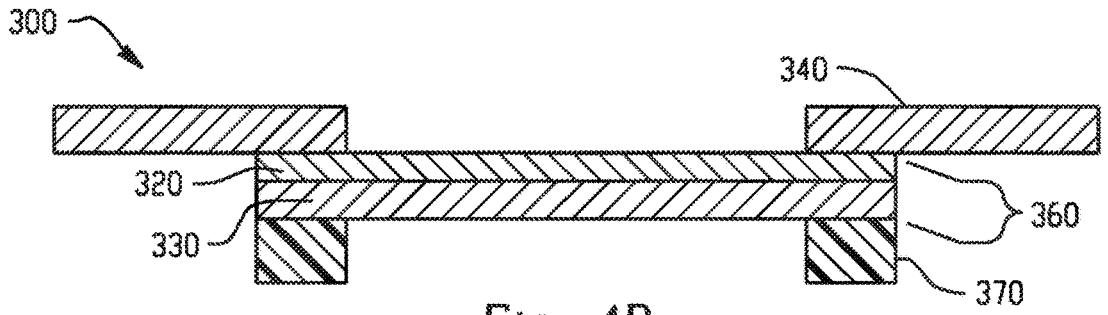
FIG. 4B is a cross-sectional view of a portion of an exemplary assembly having a viewing panel, a metal frame, and a molded thermoplastic part.
Figure 4C:
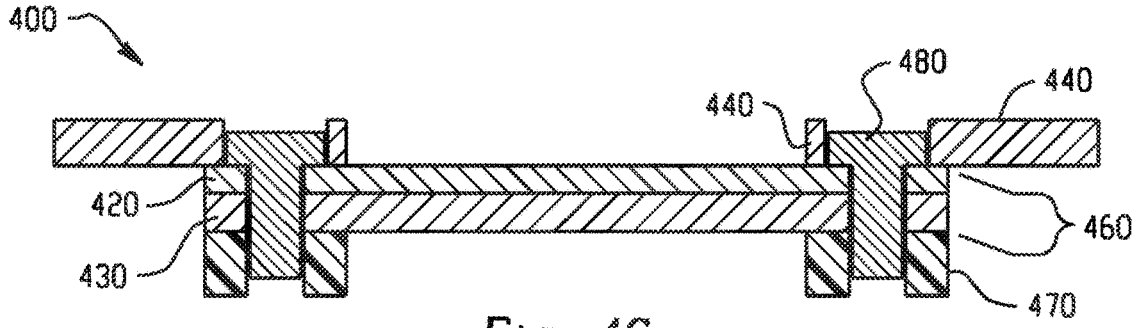
FIG. 4C is a cross-sectional view of a portion of an exemplary assembly having a viewing panel, a metal frame, a molded thermoplastic part, and a mechanical means integrating the viewing panel, metal frame, and molded thermoplastic part.
Figure 4D:
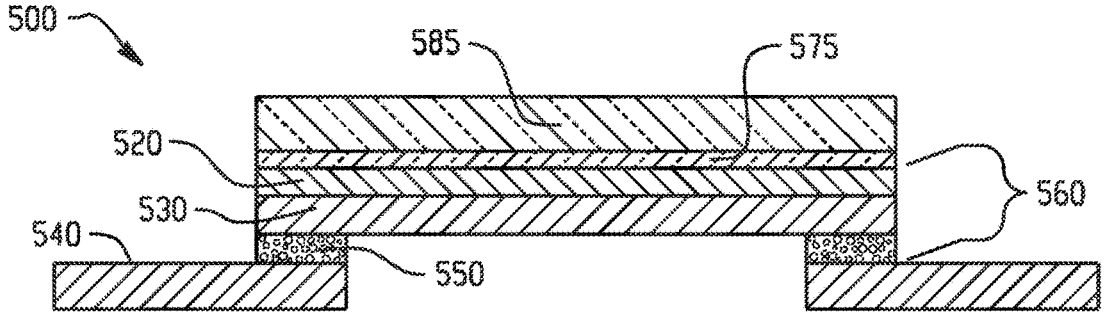
FIG. 4D is a cross-sectional view of a portion of an exemplary assembly having a viewing panel, a metal frame, a molded thermoplastic part, and a protective layer.
Figure 5:
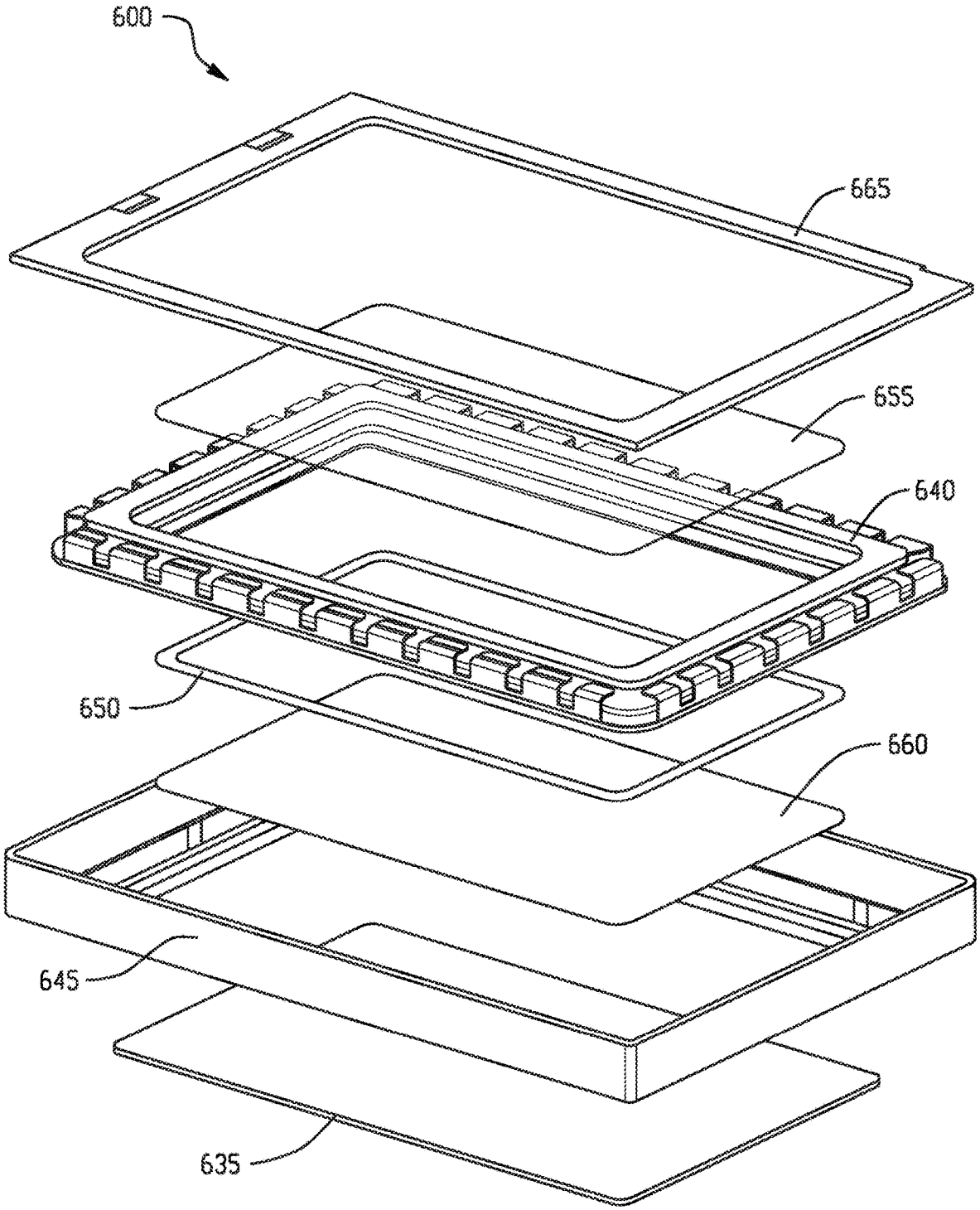
FIG. 5 is an exploded view of an exemplary assembly according to an embodiment of the disclosure.

FIG. 4A-FIG. 5 illustrate various exemplary assemblies. Assembly 200 has a metal frame 240, a viewing panel 260, which includes a substrate 230 and a conductive layer 220, and a conductive adhesive 250 disposed between and electrically connecting the metal frame 240 to the conductive layer 220. A double sided pressure sensitive adhesive (PSA)-type conductive adhesive, conductive paste, or conductive foam can be used. The type of adhesives depends on the application. If a high heat resistance characteristic (for example over 170° C.) is needed, the conductive adhesion can contain a silicone-based material for long-term stability.

In FIG. 4B, an assembly 300 has a metal frame 340, a thermoplastic molded part 370, and a viewing panel 360, which includes substrate 330 and conductive layer 320. In assembly 300, the conductive layer 320 is in direct electrical contact with the metal frame 340. The thermoplastic molded part 370 is disposed on a surface of the substrate 330 opposing the conductive layer 320. The thermoplastic molded part can be a housing, which integrates the metal frame 340 with the viewing panel 360.

In assembly 400 shown in FIG. 4C, a fastening means 480 is used to integrate metal frame 440 with molded thermoplastic part 470, and viewing panel 460, which includes substrate 430 and conductive layer 420. Fastening means is not particularly limited. In an embodiment, the fastening means is a screw. In assembly 400, the conductive layer 420 is in direct electrical contact with the metal frame 440.

Additional layers can be included in the assembly if desired. The assembly can further comprise a first protective layer disposed on the conductive lines, or a second protective layer disposed on a surface of the substrate, or a combination thereof. The protective layer can provide an underlying layer with resistance to abrasion, ultraviolet radiation, microbes, bacteria, corrosion, or a combination comprising at least one of the foregoing. In an embodiment, the protective layer is a glass layer.

The conductive pattern can be placed on the outside or inside of the assembly. When the conductive pattern is included in the assembly of a domestic appliance, the pattern can be placed as a layer within a multilayer window, such as being sandwiched between two or more transparent substrates providing protection for the conductive network.

FIG. 4D illustrates an assembly 500 that includes a viewing panel 560, a metal frame 540, a conductive adhesion layer 550 electrically connecting the conductive layer 530 to the metal frame 540, an inner glass layer 585, and an optically clear adhesive 575 disposed between the substrate 520 and inner glass layer 585.

As shown in FIG. 5, in a specific embodiment, assembly 600 includes viewing panel 660, a conductive adhesive 650 integrating the viewing panel 660 with metal frame 640. The assembly also includes a cover frame 665 and an inner glass layer 655 disposed between the metal frame 640 and cover frame 665. The assembly can further include a thermoplastic part such as a housing 645 holding the assembly. An outer glass layer 635 can be disposed inside housing 645 to provide protection to viewing panel 660. In an embodiment, a first air gap (also referred to as an inner air gap) is present between the inner glass layer 655 and the viewing panel 660 and a second air gap is present between the outer glass layer 635 and the viewing panel 660. The size of the inner air gap can be determined by the coefficient of thermal expansion of the substrate, the maximum temperature that the substrate can reach during a microwave operation, and the heat-damping requirement for the substrate.

Figure 6:
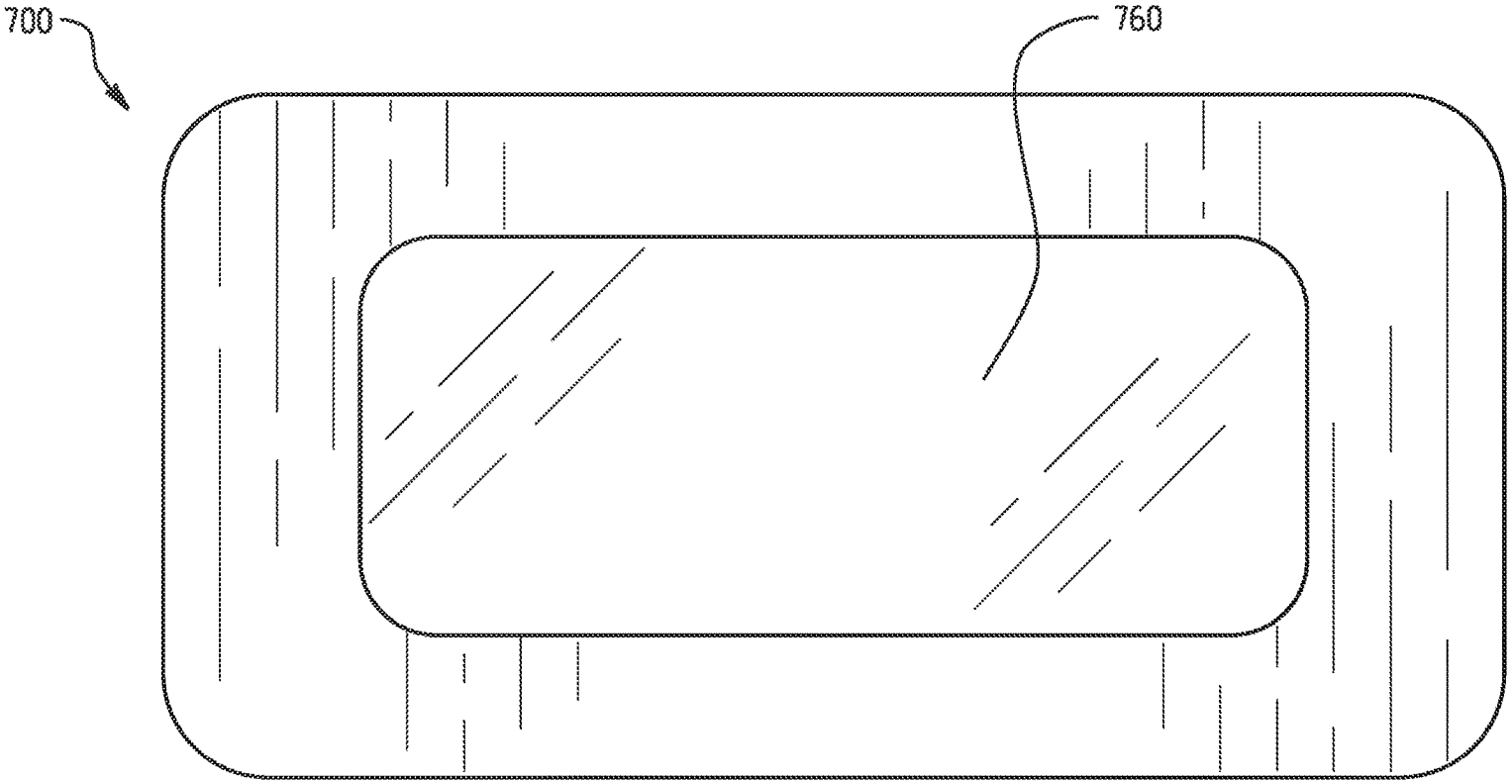
FIG. 6 is an illustration of a microwave oven door with a viewing panel as described herein.

The assembly can be a microwave oven door or a door for a microwave and convection oven combination unit. FIG. 6 is an illustration of a microwave oven door 700 with a viewing panel 760 as described herein.

The viewing panels and assemblies having balanced light transmission and electromagnetic shielding effectiveness are further illustrated by the following non-limiting examples.

EXAMPLES

Examples 1-5

Various viewing panels were constructed. Each of the panels has a substrate and conductive lines printed on the substrate. The conductive lines form a pattern having pores of various sizes. The materials of the substrate and the lines as well as the microscope images of the patterns produced are shown in Table 1. The transmittance, surface resistance, and the electromagnetic shielding effectiveness of the panels were evaluated.

As used herein, "transmittance" refers to a total transmission of light at a wavelength in the range of 360 nanometers to 750 nanometers, as measured in accordance with ASTM D-1003-00, Procedure A, under D65 illumination, with a 10 degrees observer, at a thickness of the panel as set forth in Table 1 using a Haze-Gard test device.

The surface resistance was determined in accordance with ASTM D257.

The electromagnetic shielding effectiveness was measured according to the American Society for Testing and Materials (ASTM) standard test D4935 at 2.45 GHz.

The pore area is an average pore area, measured by an Olympus MX 61 microscope.

Figure 7:
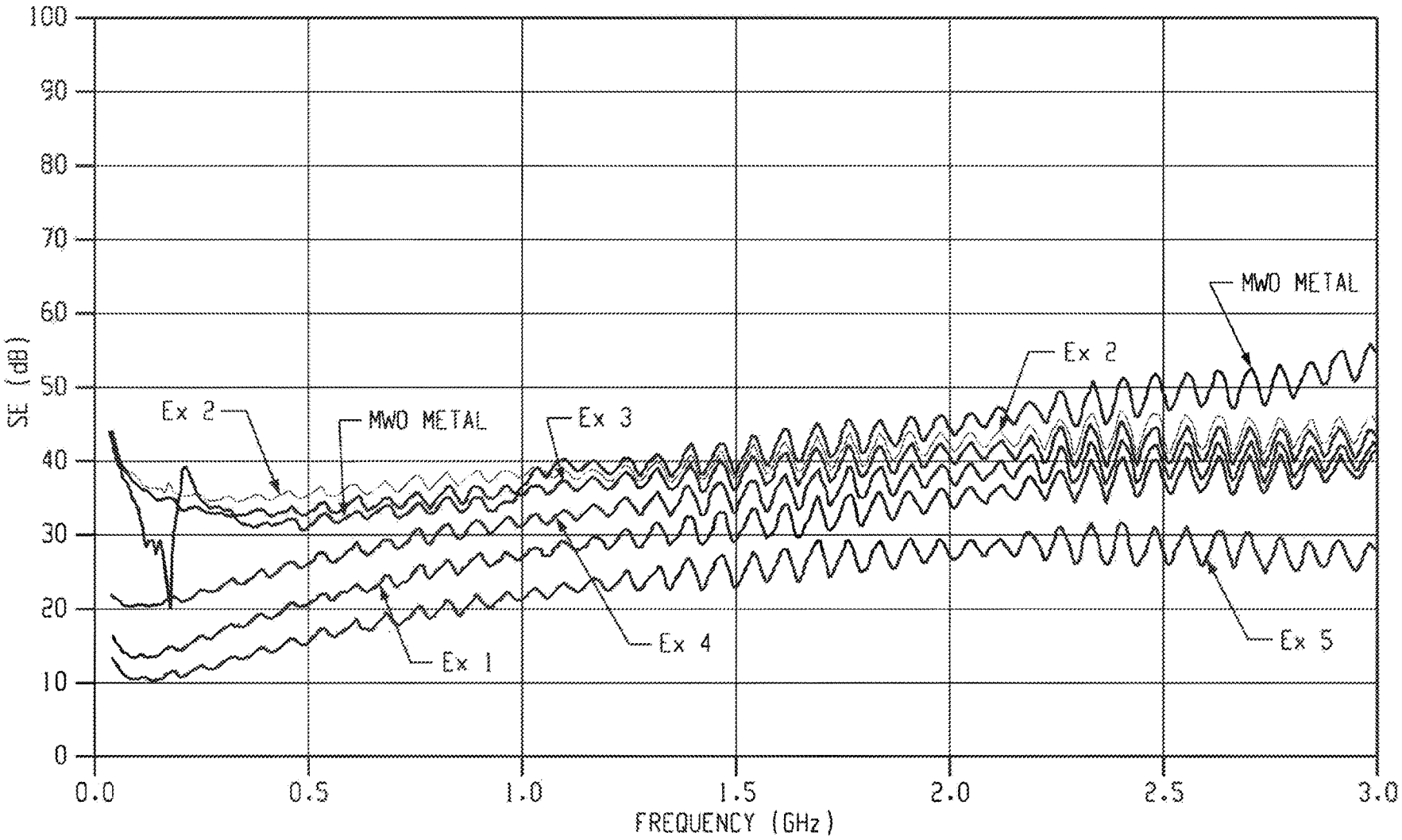
FIG. 7 depicts electromagnetic shielding effectiveness as a functional of frequency measured for the viewing panels of examples 1-5 as well as an original metal frame for a microwave oven door.

The testing results are summarized in Table 1. The shielding effectiveness results are also depicted in FIG. 7.

TABLE 1

| | Unit | Ex 1 | Ex 2 | Ex 3 | Ex 4 | Ex 5 | MTO metal* |
|---|---|---|---|---|---|---|---|
| Pattern | X 200 | 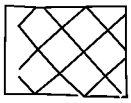 | 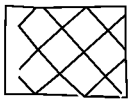 | 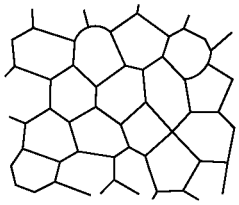 | 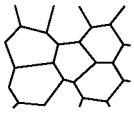 | 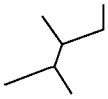 | |
| Line width | μm | <10 | <10 | <10 | 10 | 12 | |
| Line height | μm | <10 | <10 | <10 | <10 | <10 | |
| Pore area | $mm^2$ | 0.04 | 0.01 | 0.01-0.02 | 0.03-0.05 | 0.4-0.5 | |
| Line material | | Ag | Ag | Ag | Ag | Ag + Ni | |
| Substrate | | PC film | PET film | PET film | PET film | PET film | |
| Substrate thickness | mm | 0.175 | 0.15 | 0.15 | 0.15 | 0.15 | |
| Properties | | | | | | | |
| Transmittance | % | 82 | 76 | 80 | 85 | 85 | |
| Surface resistance | ohm/sq | 1.0 | 0.33 | 0.37 | 0.74 | 0.22 | |
| Shielding effective-ness@ 2.45 Ghz | dB | 37.55 | 43.97 | 42.18 | 39.95 | 28.65 | 45 |

PC: 2-phenyl-3,3'-bis(4-hydroxy phenyl)phthalimidine—bisphenol A polycarbonate copolymer.

PET: polyethylene terephthalate

*MTO metal refers to the original metal frame of a microwave oven door.

The results indicate that the pore area of the pattern has a significant effect on the electromagnetic shielding performance. Smaller pores result in better shielding effectiveness. For example, panels having a pore area of 0.01 $mm^2$ (Ex2) can have a shielding effectiveness close to that of the original metal frame of a microwave oven door.

The results also show that the pore area of the pattern has an effect on the transparency of the panels. Comparing Ex 3 with Ex 4, a panel having a pattern with a pore area of 0.01 to 0.02 $mm^2$ (Ex 3) has a transmittance of 80%, and when the pore area is increased to 0.03 to 0.05 $mm^2$ (Ex 4), the transmittance is improved to 85%. However, when the pore area reaches a certain value, further increasing the pore area does not increase the transmittance any more. In addition, increasing the pore area can lead to significant reduction in shielding effectiveness. Comparing Ex 4 with Ex 5, the pore area is increased almost 10 times from 0.03-0.05 $mm^2$ (Ex 4) to 0.4-0.5 $mm^2$ (Ex 5), yet the transmittance remains the same at 85%. Meanwhile, the shielding effectiveness at 2.45 GHz is significantly reduced from 39.95 dB (Ex 4) to 28.65 dB (Ex 5).

Examples 6 and 7

Examples 6 and 7 demonstrate the shielding effectiveness of viewing panels having a PC substrate (2-phenyl-3,3'-bis(4-hydroxy phenyl)phthalimidine—bisphenol A polycarbonate copolymer) with various thicknesses.

Viewing panels similar to that of Ex 2 except for having a PC substrate (2-phenyl-3,3'-bis(4-hydroxy phenyl)phthalimidine—bisphenol A polycarbonate copolymer) with a thickness of 0.25 mm or 0.5 mm respectively were constructed and evaluated for shielding effectiveness at 2.45 GHz. The results are shown in Table 2.

TABLE 2

| | Unit | Ex 6 | Ex 7 |
|---|---|---|---|
| Substrate thickness | mm | 0.25 | 0.5 |
| Shielding effectiveness@2.45 Ghz | dB | 45.2 | 45.2 |

Example 8

Example 8 evaluates the electromagnetic leakage of a viewing panel having a PC substrate (2-phenyl-3,3'-bis(4-hydroxy phenyl)phthalimidine—bisphenol A polycarbonate copolymer) under loading conditions.

The panel similar to that of Ex 7 was joined to a metal frame forming an assembly. The assembly was attached to a microwave oven door. The microwave oven used in the example was manufactured by LG, Model #MJ324SWT with a volume of 32 L and a power of 900 Watts.

Figure 8:
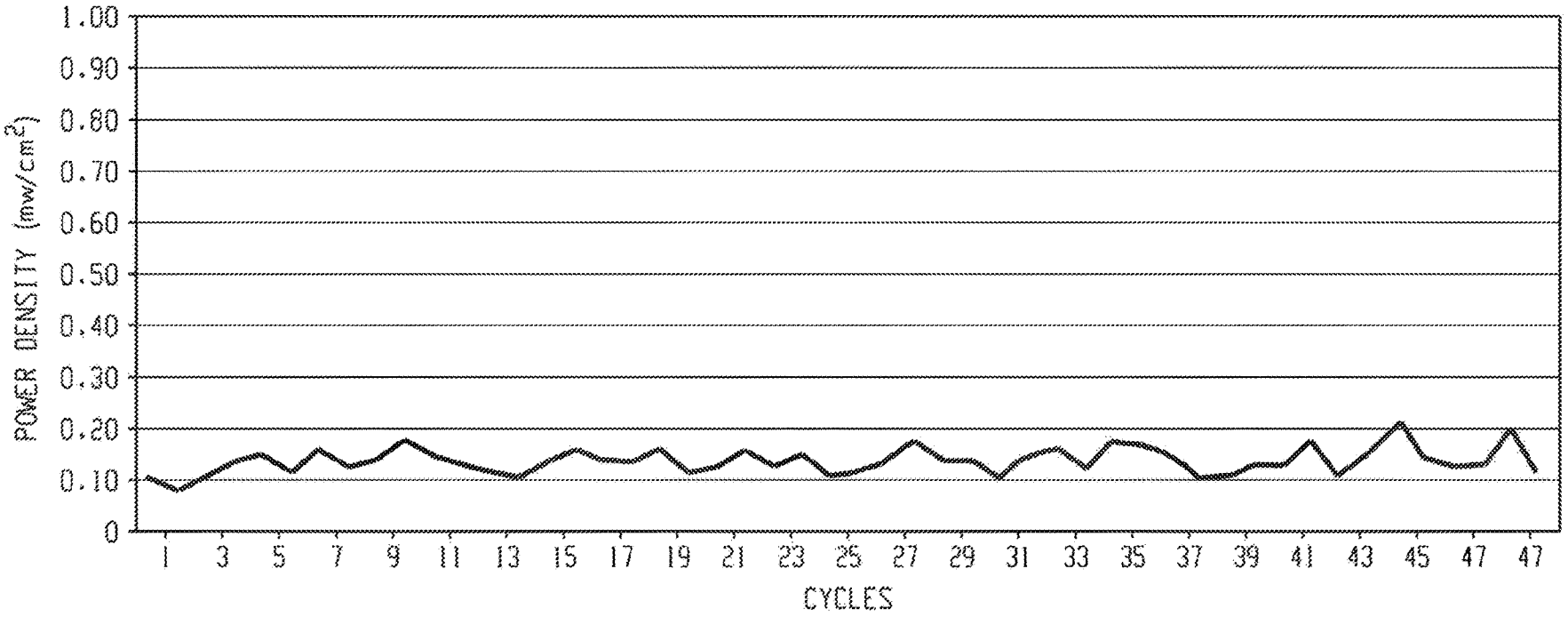
FIG. 8 depicts electromagnetic leakage as a function of the number of loading cycles for the assembly of Example 8.

A beaker with 900 milliliters (mL) of tap water was placed inside the microwave oven. The microwave oven was run at a microwave mode for 30 minutes, and then cooled down for 30 minutes. Next, the microwave oven was run at a microwave mode for 4 minutes under unloading conditions then cooled down for 4 minutes. Then the microwave oven was run at convection mode for 60 minutes under loading conditions and cooled down for 60 minutes. A probe was set in front of the microwave oven door to measure the radiation emission. The cycle was repeated. The electromagnetic leakage measured as power density versus loading cycle was depicted in FIG. 8. The results indicate that the viewing panel has an electromagnetic leakage well below 1.0 $mW/cm^2$ at 2.45 GHz even after 50 cycles.

Example 9

Example 9 evaluates the electromagnetic leakage of a viewing panel having a PC substrate (2-phenyl-3,3'-bis(4-hydroxy phenyl)phthalimidine—bisphenol A polycarbonate copolymer) under loading or unloading conditions.

A panel of Ex. 8 was joined to a metal frame forming an assembly. The assembly was attached to a microwave oven door. The microwave oven used in the example was manufactured by LG, Model #MJ324SWT with a volume of 32 L and a power of 900 Watts.

Figure 9:
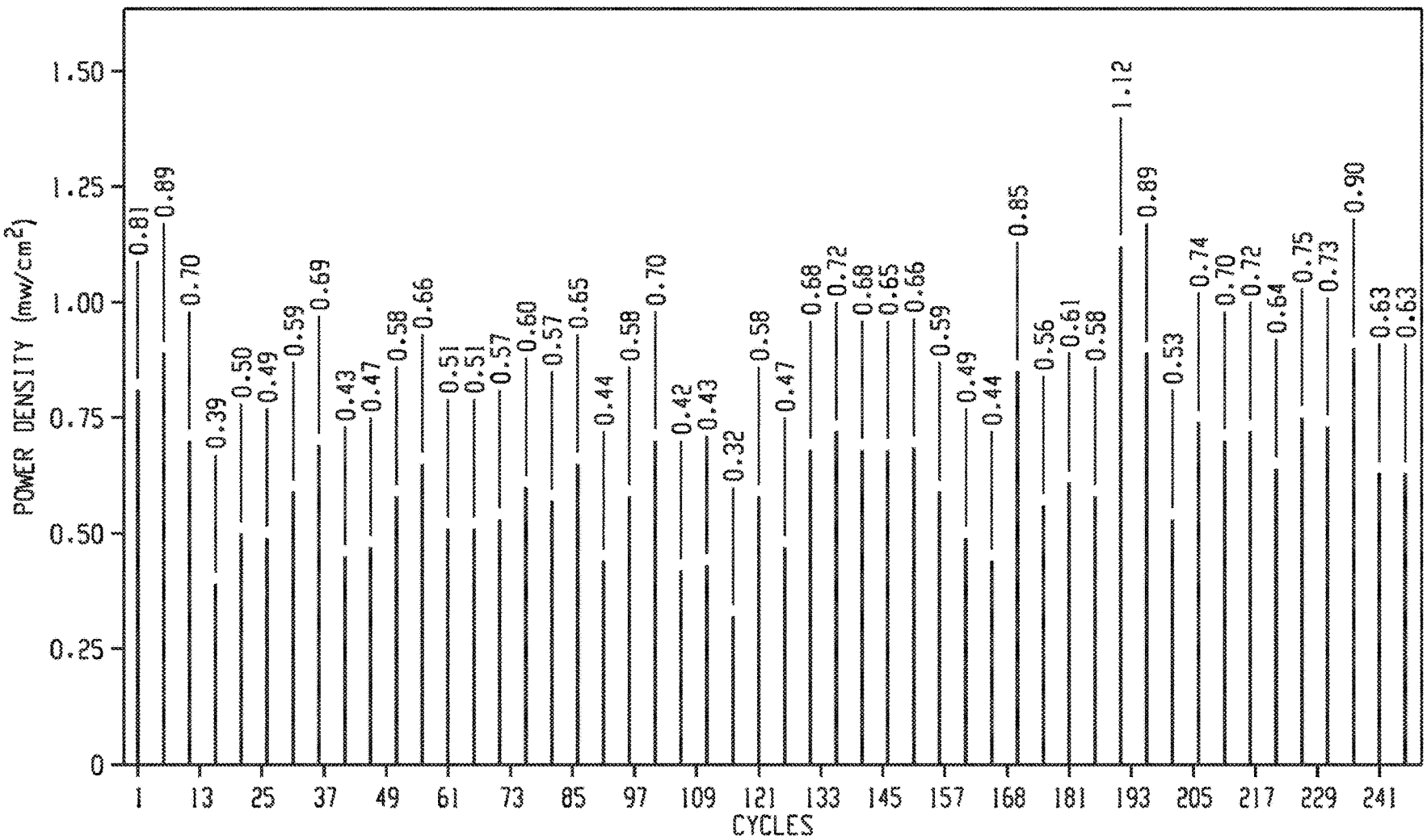
FIG. 9 depicts electromagnetic leakage as a function of the number of cycles for the assembly of Example 9 under unloading conditions.

The microwave oven was run for four minutes under unloading condition at the microwave mode. A probe was set in front of the microwave oven door. The electromagnetic leakage was measured every five cycles as power density. The power density versus unloading cycle was depicted in FIG. 9. The results indicate that the viewing panel has an electromagnetic leakage of about 1.0 $mW/cm^2$ at 2.45 GHz even after 250 cycles under unloading conditions.

Figure 10:
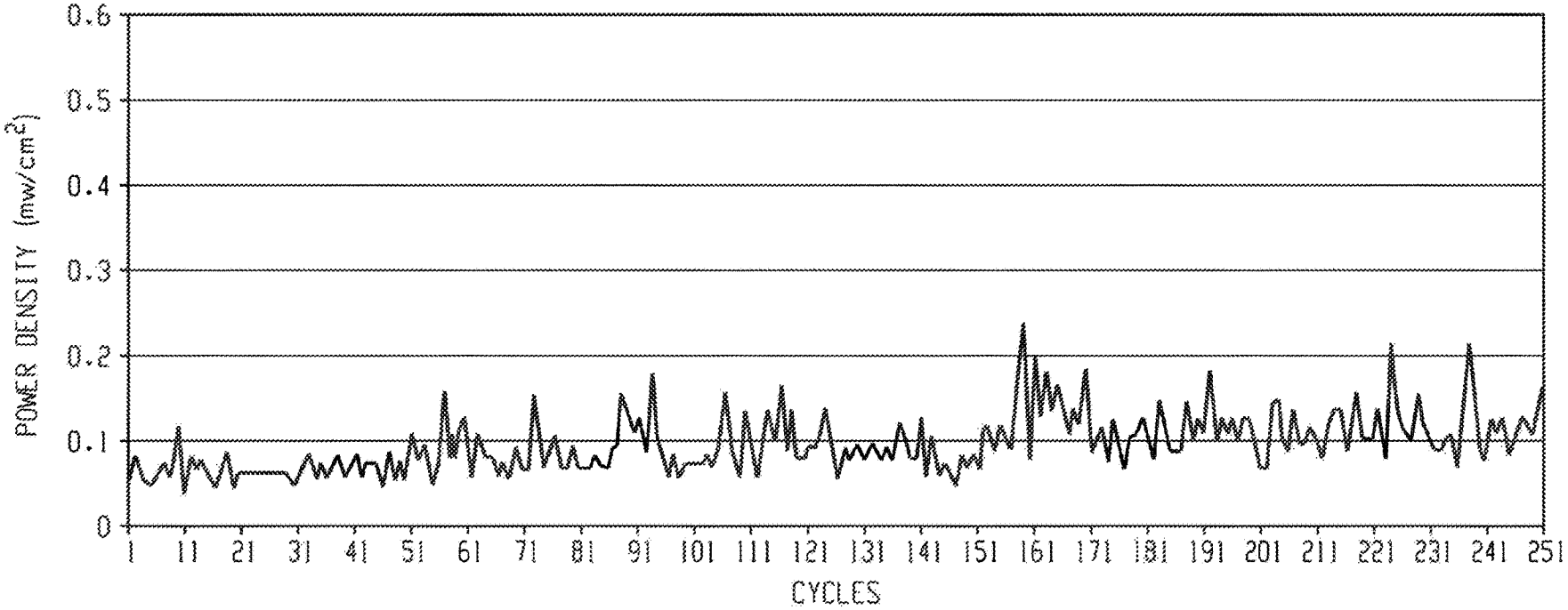
FIG. 10 depicts electromagnetic leakage as a function of the number of loading cycles for the assembly of Example 9 under loading conditions.

A beaker with 2 L of tap water was placed inside the microwave oven. The microwave oven was run at a microwave mode for 60 minutes, and then cooled down for 30 minutes. A probe was set in front of the microwave oven door to measure the radiation emission. The cycle was repeated. The electromagnetic leakage was measured as power density. Power density versus loading cycle was depicted in FIG. 10. The results indicate that the viewing panel has an electromagnetic leakage below 0.3 $mW/cm^2$ at 2.45 GHz under loading conditions even after 250 cycles.

Example 10

Example 10 evaluates the heat resistance of the viewing panels according to the disclosure.

The assembly of Ex. 9 was attached to a microwave oven door. The microwave oven was run at different modes to measure the actual surface temperature that the viewing panel was exposed to through a thermocouple. Set temperatures of dry oven for an extended period of time as shown in Table 3 were determined. There is no film detachment or any deformation on the surface of the viewing panel after a total of 600 hours of testing. The results show that the viewing panels according to the disclosure have excellent heat resistance.

TABLE 3

| Mode | Dry oven Set Temp. (° C.) | Time (hours) | Operation Time (days) |
|---|---|---|---|
| Convection | 163 | 144 | 6 days → |
| Grill | 110 | 168 | 7 days → |

TABLE 3-continued

| Mode | Dry oven Set Temp. (° C.) | Time (hours) | Operation Time (days) |
|---|---|---|---|
| Convection | 163 | 120 | 5 days → |
| Crisp | 85 | 168 | 7 days → |

*Set temperature of dry oven was determined by measuring the actual temperature of the substrate surface under each mode.

The viewing panel also has an electromagnetic leakage below 1.0 mW/cm$^2$ at 2.45 GHz under loading conditions as defined in UL 923. The result shows that the panel also have excellent microwave shielding reliability.

Set forth are various aspects of the disclosure.

Aspect 1. A viewing panel (30, 40, 50, 60, 70, 80) for a domestic appliance comprising: a substrate (33, 43, 53, 63, 73, 83) and a conductive layer (35, 45, 55, 65, 75, 85) disposed on the substrate; the conductive layer comprising conductive lines (31, 41, 51, 61, 71, 81) forming a pattern, the viewing panel characterized in that: the substrate comprises a polymeric material; the conductive lines have a height (H) of 0.5 micrometers to 10 micrometers determined by an Olympus MX61 microscope; and the pattern has an average pore area of 0.008 square millimeters to 0.06 square millimeters determined by an Olympus MX61 microscope; wherein the viewing panel has: a total transmission of greater than 70% of light having a wavelength in the range of 360 nanometers to 750 nanometers determined according to ASTM D-1003-00, Procedure A, under D65 illumination, with a 10 degrees observer, at a sample thickness of 0.15 millimeter using a Haze-Gard test device; and an electromagnetic shielding efficiency of greater than 30 dB at 2.45 GHz as determined by ASTM D4935.

Aspect 2. The viewing panel of Aspect 1 or Aspect 2, wherein one or more of the following conditions apply: the viewing panel has a surface resistance of less than or equal to 1.0 ohm/sq; or the viewing panel has an electromagnetic leakage of less than 1.0 mW/cm$^2$ at 2.45 GHz under loading conditions as defined in UL923.

Aspect 3. The viewing panel of any one of Aspects 1 to 2, wherein the polymeric material has a glass transition temperature that is equal to or greater than the maximum surface temperature of the base substrate during a microwave operation, and wherein optionally the polymeric material has a glass transition temperature of 100° C. to 250° C., preferably 140° C. to 195° C., and more preferably 150° C. to 250° C. determined by differential scanning calorimetry (DSC) as per ASTM D3418 with a 20° C./min heating rate.

Aspect 4. The viewing panel of any one of Aspects 1 to 2, wherein the base substrate is rated for a maximum surface temperature during microwave oven operation, and wherein the polymeric material has a glass transition temperature that is equal to or greater than a maximum surface temperature, preferably greater than the maximum surface temperature, and more preferably greater than 10° C. above the maximum surface temperature.

Aspect 5. The viewing panel of any one of Aspects 1 to 4, wherein the polymeric material comprises a polycarbonate.

Aspect 6. The viewing panel of any one of Aspects 1 to 5, wherein the polymeric material comprises a copolycarbonate having bisphenol A carbonate units and phthalimidine carbonate units.

Aspect 7. The viewing panel of any one of Aspects 1 to 6, wherein the conductive lines comprise at least one of silver, copper, nickel, and aluminum, and preferably the conductive lines comprise an alloy of at least one of silver, copper, nickel, and aluminum.

Aspect 8. The viewing panel of any one of Aspects 1 to 7, wherein the conductive lines are directly disposed on a surface of the base substrate.

Aspect 9. The viewing panel of any one of Aspects 1 to 7, wherein the conductive layer further comprises a polymer film (32, 42, 52, 62) and the conductive lines are imprinted on the polymer film.

Aspect 10. The viewing panel of any of the preceding Aspects, wherein the viewing panel has an electromagnetic leakage of less than 1.0 mW/cm$^2$, preferably less than or equal to 0.7 mW/cm$^2$, or less than or equal to 0.5 mW/cm$^2$, at 2.45 GHz under loading conditions as defined in UL923.

Aspect 11. An assembly (200, 300, 400, 500, 600) for a domestic appliance comprising: the viewing panel (260, 360, 460, 560, 660) of any one of Aspects 1 to 10; and a metal frame (240, 340, 440, 540, 640); wherein the conductive lines of the viewing panel are electrically grounded to the metal frame.

Aspect 12. The assembly of Aspects 11, further comprising a conductive adhesive (250, 550, 650) electrically connecting the conductive lines of the viewing panel to the metal frame.

Aspect 13. The assembly of Aspect 12, wherein the conductive adhesive comprises a silicone based adhesive.

Aspect 14. The assembly of any one of Aspects 11 to 13, further comprising a thermoplastic molded part (370, 470) disposed on a surface of the base substrate (330, 430) opposing the conductive lines.

Aspect 15. The assembly of any one of Aspects 11 to 14, wherein the conductive lines that are in direct electrical contact with the metal frame or in direct electrical contact with the conductive adhesive have a width (W2) of greater than 10 millimeters.

Aspect 16. The assembly of any one of Aspects 11 to 15, further comprising a first glass layer disposed on the conductive lines, or a second glass layer (585) disposed on a surface of the base substrate (520), or a combination thereof.

Aspect 17. The assembly of any one of Aspects 11 to 15, further comprising a first glass layer (635) and a second glass layer (655), wherein the viewing panel is disposed between the first glass layer and the second glass layer; and preferably wherein a first air gap is disposed between the first glass layer and the viewing panel and a second air gap is disposed between the second glass layer and the viewing panel.

Aspect 18. The assembly of any one of Aspects 11 to 17, wherein the assembly is a microwave oven door or a door for a microwave and convection oven combination unit.

Aspect 19. The assembly of any one of Aspects 11 to 18, wherein the conductive lines are in direct electrical contact with the metal frame.

Aspect 20. A method of forming a viewing panel (30, 40, 50, 60, 70, 80) for a domestic appliance comprising: forming a conductive pattern via conductive lines (31, 41, 51, 61, 71, 81) directly on a substrate (33, 43, 53, 63, 73, 83) or on a polymer film (32, 42, 52, 62) disposed on a surface of the substrate, the method characterized in that: the conductive lines have a height (H) of 0.5 micrometers to 10 micrometers determined by an Olympus MX61 microscope; the conductive pattern has an average pore area of 0.008 square millimeters to 0.06 square millimeters determined by an Olympus MX61 microscope, and the base substrate comprises a polymeric material, wherein the viewing panel has: a total transmission of greater than 70% of light having a wavelength in the range of 360 nanometers to 750 nanometers determined according to ASTM D-1003-00, Procedure A, under D65 illumination, with a 10 degrees observer, at a sample thickness of 0.15 millimeter using a Haze-Gard test device; and an electromagnetic shielding efficiency of greater than 30 dB at 2.45 GHz as determined by ASTM D4935.

Aspect 21. A method of forming an assembly (200, 300, 400, 500, 600) for a domestic appliance comprising: forming a conductive pattern via conductively lines (31, 41, 51, 61, 71, 81) directly on a substrate (33, 43, 53, 63, 73, 83) or on a polymer film (32, 42, 52, 62) disposed on a surface of the substrate to form a viewing panel (260, 360, 460, 560, 660), and integrating the viewing panel with a metal frame (240, 340, 440, 540, 640), the method characterized in that; the conductive lines have a height (H) of 0.5 micrometers to 10 micrometers determined by an Olympus MX61 microscope; the conductive pattern has an average pore area of 0.008 square millimeters to 0.06 square millimeters determined by an Olympus MX61 microscope; the substrate comprises a polymeric material; and the viewing panel is electrically grounded to the metal frame; wherein the viewing panel has a total transmission of greater than 70% of light having a wavelength in the range of 360 nanometers to 750 nanometers determined according to ASTM D-1003-00, Procedure A, under D65 illumination, with a 10 degrees observer, at a sample thickness of 0.15 millimeter using a Haze-Gard test device; and an electromagnetic shielding efficiency of greater than 30 dB at 2.45 GHz as determined by ASTM D4935.

Aspect 22. The method of any one of Aspect 20 or Aspect 21, wherein the base substrate has a maximum surface temperature that the base substrate will attain during microwave oven operation, wherein the base substrate comprises the polymeric material, and wherein the polymeric material has a glass transition temperature that is equal to or greater than the maximum surface temperature, preferably greater than the maximum surface temperature, and more preferably greater than 10° C. above the maximum surface temperature.

Aspect 23. The method of Aspect 22, further comprising, determining a maximum surface temperature that the base substrate will attain during microwave oven operation, and choosing a polymeric material that has a glass transition temperature that is equal to or greater than the maximum surface temperature, preferably greater than the maximum surface temperature, and more preferably greater than 10° C. above the maximum surface temperature.

The singular forms "a," "an," and "the" include plural referents unless the context clearly dictates otherwise. "Or" means "and/or" unless clearly indicated otherwise by context. Unless defined otherwise, technical and scientific terms used herein have the same meaning as is commonly understood by one of skill in the art to which this invention belongs. A "combination" is inclusive of blends, mixtures, alloys, reaction products, and the like. "One or more of the foregoing" means at least one the listed material.

Unless otherwise specified herein, any reference to standards, regulations, testing methods and the like refers to the standard, regulation, guidance or method that is in force at the time of filing of the present application.

As used herein, glass transition temperature is determined by differential scanning calorimetry (DSC) as per ASTM D3418 with a 20° C./min heating rate.

All cited patents, patent applications, and other references are incorporated herein by reference in their entirety. However, if a term in the present application contradicts or conflicts with a term in the incorporated reference, the term from the present application takes precedence over the conflicting term from the incorporated reference.

While typical embodiments have been set forth for the purpose of illustration, the foregoing descriptions should not be deemed a limitation on the scope herein. Accordingly, various modifications, adaptations, and alternatives can occur to one skilled in the art without departing from the spirit and scope herein.

We claim:

1. A viewing panel (30, 40, 50, 60, 70, 80) for a domestic appliance comprising:

a substrate (33, 43, 53, 63, 73, 83) comprising a polymeric material having a glass transition temperature of 100° C. to 250° C. determined by differential scanning calorimetry (DSC) as per ASTM D3418 with a 20° C./min heating rate; and a conductive layer (35, 45, 55, 65, 75, 85) disposed on the substrate; the conductive layer comprising conductive lines (31, 41, 51, 61, 71, 81) forming a pattern having an average pore area of 0.008 square millimeters to 0.06 square millimeters determined by a microscope; wherein the conductive lines have a height (H) of 0.5 micrometers to 10 micrometers determined by a microscope; and wherein the viewing panel has:

a surface resistance of less than or equal to 1.0 ohm/sq;

an electromagnetic leakage of less than 1.0 mW/cm$^2$ at 2.45 GHz under loading conditions as defined in UL923; and a total transmission of greater than 70% of light having a wavelength in the range of 360 nanometers to 750 nanometers determined according to ASTM D-1003-00, Procedure A, under D65 illumination, with a 10 degrees observer, at a sample thickness of 0.15 millimeter; and an electromagnetic shielding efficiency of greater than 30 dB at 2.45 GHz as determined by ASTM D4935.

2. The viewing panel of claim 1, wherein one or more of the following conditions apply:

the polymeric material has a glass transition temperature that is equal to or greater than a maximum surface temperature of the substrate during a microwave operation, and wherein the polymeric material has a glass transition temperature of 140° C. to 250° C., determined by differential scanning calorimetry (DSC) as per ASTM D3418 with a 20° C./min heating rate.

3. The viewing panel of claim 1, wherein the polymeric material comprises a polycarbonate; and the conductive lines comprise at least one of silver, copper, nickel, and aluminum.

4. The viewing panel of claim 1, wherein the polymeric material comprises a copolycarbonate having bisphenol A carbonate units and phthalimidine carbonate units.

5. The viewing panel of claim 1, wherein the conductive lines are directly disposed on a surface of the substrate.

6. The viewing panel of claim 1, wherein the conductive layer further comprises a polymer film (32, 42, 52, 62) and the conductive lines are imprinted on the polymer film.

7. An assembly (200, 300, 400, 500, 600) for a domestic appliance comprising:

the viewing panel (260, 360, 460, 560, 660) of claim 1; and a metal frame (240, 340, 440, 540, 640);

wherein the conductive lines of the viewing panel are electrically grounded to the metal frame; and optionally wherein the assembly is a microwave oven door or a door for a microwave and convection oven combination unit.

8. The assembly of claim 7, further comprising a conductive adhesive (250, 550, 650) electrically connecting the conductive lines of the viewing panel to the metal frame, and optionally wherein the conductive adhesive (250, 550, 650) comprises a silicone based adhesive.

9. The assembly of claim 7, wherein the conductive lines are in direct electrical contact with the metal frame.

10. The assembly of claim 7, further comprising a thermoplastic molded part (370, 470) disposed on a surface of the substrate (330, 430) opposing the conductive lines.

11. The assembly of claim 7, wherein the conductive lines that are in direct electrical contact with the metal frame or in direct electrical contact with the conductive adhesive have a width (W2) of greater than 10 millimeters.

12. The assembly of claim 7, further comprising a first glass layer disposed on the conductive lines, or a second glass layer (585) disposed on a surface of the substrate (520), or a combination thereof.

13. The assembly of claim 7, further comprising a first glass layer (635) and a second glass layer (655), wherein the viewing panel is disposed between the first glass layer and the second glass layer.

14. A method of forming a viewing panel (30, 40, 50, 60, 70, 80) for a domestic appliance comprising:

forming a conductive pattern via conductive lines (31, 41, 51, 61, 71, 81) directly on a substrate (33, 43, 53, 63, 73, 83) or on a polymer film (32, 42, 52, 62) disposed on a surface of the substrate, the conductive lines having a height (H) of 0.5 micrometers to 10 micrometers determined by a microscope;

the conductive pattern having an average pore area of 0.008 square millimeters to 0.06 square millimeters determined by a microscope, and the base substrate comprising a polymeric material having a glass transition temperature of 100° C. to 250° C. determined by differential scanning calorimetry (DSC) as per ASTM D3418 with a 20° C./mm heating rate, wherein the viewing panel has:

a surface resistance of less than or equal to 1.0 ohm/sq;

an electromagnetic leakage of less than 1.0 mW/cm$^2$ at 2.45 GHz under loading conditions as defined in UL923; and a total transmission of greater than 70% of light having a wavelength in the range of 360 nanometers to 750 nanometers determined according to ASTM D-1003-00, Procedure A, under D65 illumination, with a 10 degrees observer, at a sample thickness of 0.15 millimeter; and an electromagnetic shielding efficiency of greater than 30 dB at 2.45 GHz as determined by ASTM D4935.

15. A method of forming an assembly (200, 300, 400, 500, 600) for a domestic appliance comprising:

forming a conductive pattern via conductively lines (31, 41, 51, 61, 71, 81) directly on a substrate (33, 43, 53, 63, 73, 83) or on a polymer film (32, 42, 52, 62) disposed on a surface of the substrate to form a viewing panel (260, 360, 460, 560, 660), the conductive lines having a height (H) of 0.5 micrometers to 10 micrometers determined by a microscope, the conductive pattern having an average pore area of 0.008 square millimeters to 0.06 square millimeters determined by a microscope, and the substrate comprising a polymeric material having a glass transition temperature of 100° C. to 250° C. determined by differential scanning calorimetry (DSC) as per ASTM D3418 with a 20° C./mm heating rate; and integrating the viewing panel with a metal frame (240, 340, 440, 540, 640), wherein the viewing panel is electrically grounded to the metal frame;

wherein the viewing panel has a surface resistance of less than or equal to 1.0 ohm/sq;

and electromagnetic leakage of less than 1.0 mW/cm$^2$ at 2.45 GHz under loading conditions as defined in UL923; and a total transmission of greater than 70% of light having a wavelength in the range of 360 nanometers to 750 nanometers determined according to ASTM D-1003-00, Procedure A, under D65 illumination, with a 10 degrees observer, at a sample thickness of 0.15 millimeter; and an electromagnetic shielding efficiency of greater than 30 dB at 2.45 GHz as determined by ASTM D4935.

16. The assembly of claim 13, wherein a first air gap is disposed between the first glass layer and the viewing panel and a second air gap is disposed between the second glass layer and the viewing panel.

* * * * *